United States Patent [19]

Bruinsma et al.

[11] Patent Number: 4,868,578

[45] Date of Patent: Sep. 19, 1989

[54] PORTABLE REFLECTOR ANTENNA ASSEMBLY

[76] Inventors: Robert F. Bruinsma, 5537 Cochran St., Simi Valley, Calif. 93063; Delmer L. Thomas, 11572 E. Presilla Rd., Camarillo, Calif. 93010

[21] Appl. No.: 73,169

[22] Filed: Jul. 13, 1987

[51] Int. Cl.[4] ..... H01Q 1/27; H01Q 3/08

[52] U.S. Cl. ..... 343/882; 343/878; 343/880; 343/881

[58] Field of Search ..... 343/765, 766, 840, 878, 343/880, 881, 882

[56] References Cited

U.S. PATENT DOCUMENTS

| | | | |
|---|---|---|---|
| 4,404,565 | 9/1983 | Gurney et al. | 343/882 |
| 4,656,486 | 4/1987 | Turner | 343/882 |

FOREIGN PATENT DOCUMENTS

| | | | |
|---|---|---|---|
| 0129408 | 10/1981 | Japan | 343/878 |
| 0014506 | 1/1985 | Japan | 343/878 |
| 0233905 | 11/1985 | Japan | 343/881 |

*Primary Examiner*—William L. Sikes
*Assistant Examiner*—B. R. R. Holloway
*Attorney, Agent, or Firm*—Edward A. Sokolski

[57] ABSTRACT

A portable reflector antenna assembly which is readily assemblable and disassemblable for use in the field has a triangular base frame employing three beam members which are joined together at their ends with hinge type knuckles which are slidably positioned on three legs. The legs have integral cup shaped pads near the bottom ends thereof and are driven into the ground until the cups abut against the ground to provide lateral and vertical support in the soil. The frame can be adjusted on the legs for both height and leveling by virtue of the slidable movement of each of the knuckles along the legs, and when in the desired position are clamped to the legs by means of lever-cam actuated draw bolts. The reflector member of the antenna is supported along its rim by means of pivotal supports and clamps, the bottom edge of the antenna being slidably adjustable in azimuth along the curved front beam member of the frame and clamped to the front beam member by means of clamping members. The top edge of the reflector member is supported for slidable adjustment in elevation along a shaft which is pivotally supported on a rear leg and which rises upwardly from said leg. The reflector, after having been adjusted in elevation along the shaft, is clamped to the shaft in the desired elevation position. A compass and levels are provided for leveling and adjusting the triangular frame in azimuth, an azimuth scale being provided on the curved beam and an elevation scale on the shaft to facilitate the positioning of the antenna in desired azimuth and elevation positions.

5 Claims, 2 Drawing Sheets

PORTABLE REFLECTOR ANTENNA ASSEMBLY

This invention relates to communications antennas and more particularly to such an antenna assembly employing a reflector which is portable in nature and suitable for use in the field.

Antenna assemblies employing reflectors or "dishes" have been used for a number of years for point to point communications and more recently for satellite communications. Such antenna assemblies are described in U.S. Pat. No. 4,204,214 issued May 20, 1980 to Datron Systems, Inc., the assignee of the present application and U.S. Pat. No. 2,651,721 issued Sept. 8, 1953 to Bergey, et al. The antenna assemblies of these two patents employ motor driven positioners and are somewhat bulky and complicated in their construction such as to be unsuitable for portable use where rapid assembly and disassembly is required. Further, the gearing and sprocket type arrangements of the drive systems of these prior art patents do not lend themselves to rough handling which repeated assembly and disassembly in the field entails.

Portable, more compact type reflector antenna assemblies are described on pages 270, 271 and 277 of *Janes's Military Communications,* Second Edition 1981 edited by R. J. Raggett, published by Jane's Publishing Inc. The antenna assemblies described in this publication while transportable still are overly complicated in their construction and from what can be gleaned from the brief descriptions provided employ gear type drives and other features which would tend to provide maintenance problems with the sort of handling to be expected on repeated assembly and disassembly in the field.

The present invention obviates the aforementioned shortcomings of the prior art in providing a very simple, easily maintainable antenna assembly which can readily be assembled and disassembled for transportation in a relatively short period of time. The improvement is achieved in the assembly of the present invention by employing a triangular support frame formed from three separate beams which are supported on triangularly positioned legs to which the ends of the beams are joined by means of hinge-type knuckles. The legs are driven into the ground and firmly supported thereon by means of cup shaped pads through which the ends of the legs fit with the pads resting on the ground. The support frame has levels and a compass mounted thereon to enable leveling and positioning of the frame in azimuth. The reflector and its associated hardware are supported on the frame with the lower edge of the reflector supported on a pair of pivot joints having clamps attached thereto. The reflector can be adjusted to a desired azimuth position along one of the beams of the base frame, which is curved, and then clamped to this curved beam in the desired position by means of the clamps.

The reflector is supported in a desired elevation position by means of a shaft which is pivotally attached to a clamp member which is clamped to the leg of the frame opposite the curved beam. This end result is achieved by means of a clamping member which is pivotally attached to a top edge of the reflector and which can be slidably positioned along the shaft to bring the reflector to a desired elevation position whereat it is clamped to the shaft.

It is therefore an object of this invention to provide a simple and economical antenna assembly for use in the field.

It is a further object of this invention to provide an easy assemblable and disassemblable portable reflector antenna assembly which has a simple, relatively maintenance free type of construction.

Other objects of the invention will become apparent as the description proceeds in connection with the accompanying drawings of which:

Figures 1, 1A, 3:
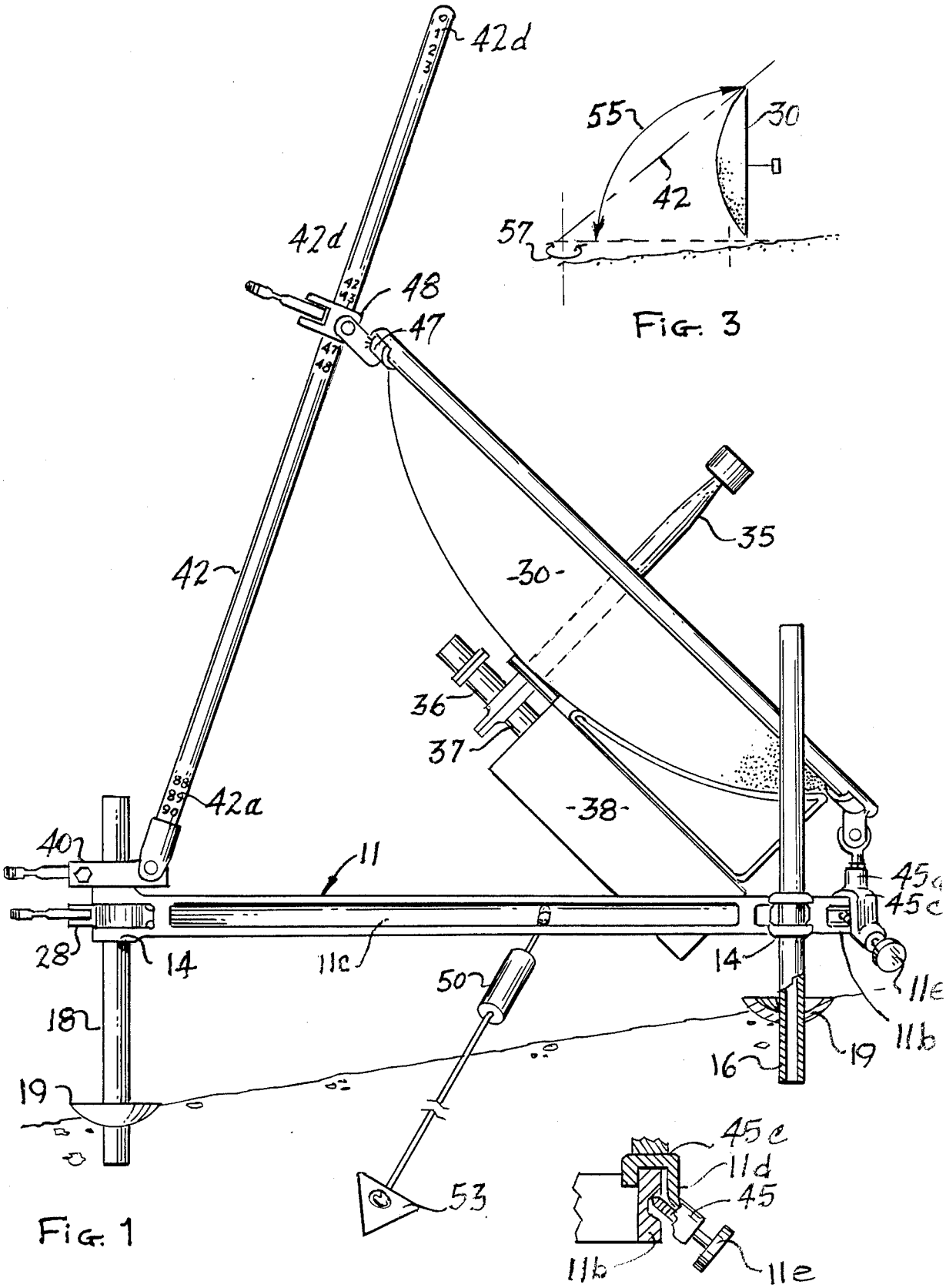
FIG. 1 is a side elevational view of a preferred embodiment of the invention.
FIG. 1A is a perspective view partially in cross section of one of the front clamps of the preferred embodiment.
FIG. 3 is a schematic drawing illustrating the altitude adjustment of the preferred embodiment.
Figure 2:
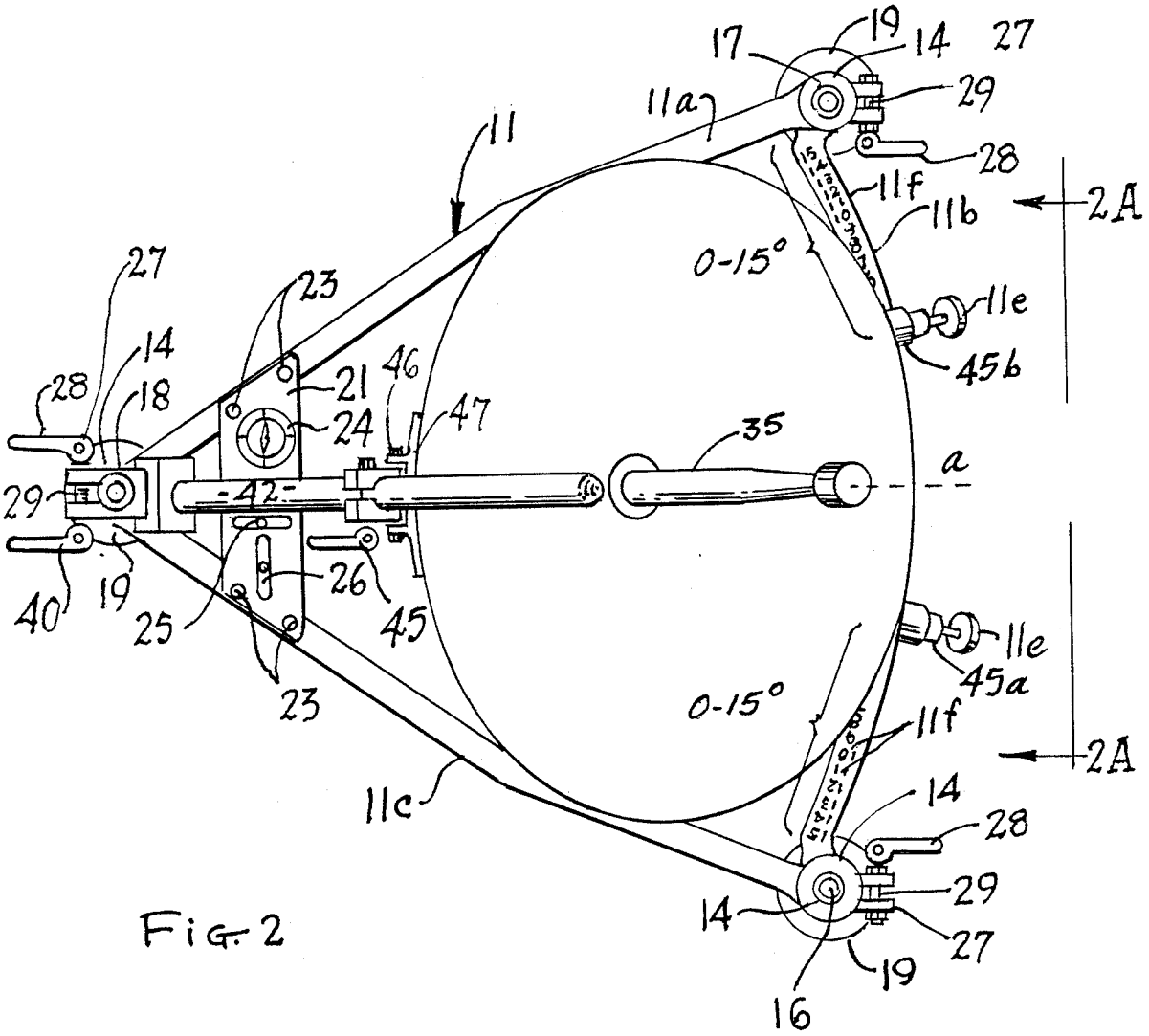
FIG. 2 is a top plan view of the preferred embodiment.

Referring now to FIGS. 1–3, a preferred embodiment of the invention is shown. Triangular base frame member 11 is formed from three light weight beams 11*a*, 11*b* and 11*c* which may be of a material such as aluminum. These beams have hinge type knuckles 14 at each of the opposite ends thereof, these knuckles each being slidably mounted on a respective of legs 16–18. Legs 16–18 each has a cup shaped pad 19 fixedly attached thereto through which the ends of the legs extend. The ends of the legs are installed in the ground with the pads 19 abutting against the ground to stabilize the legs. Frame 11 has a platform 21 attached thereto between beams 11*a* and 11*c* by means of bolts 23. Mounted on platform 21 is a compass 24 and a pair of bubble levels 25 and 26. Thus, frame 11 can initially be aligned in azimuth such that the center line "a" of the frame is aligned in a predetermined direction as determined by compass 24. The knuckles 14 of the frame can then be slided along their respective legs 16–18 to level the frame as indicated by bubble levels 25 and 26. Also, the height of frame 11 along legs 16–18 can be set as may be desired. Once set in the desired position on the legs, the beams are clamped to the legs by means of clamps 27 which include hand operated lever-cam actuators 28 which operate in conjunction with draw bolts 29 to clamp the knuckles to the legs.

Figure 2A:
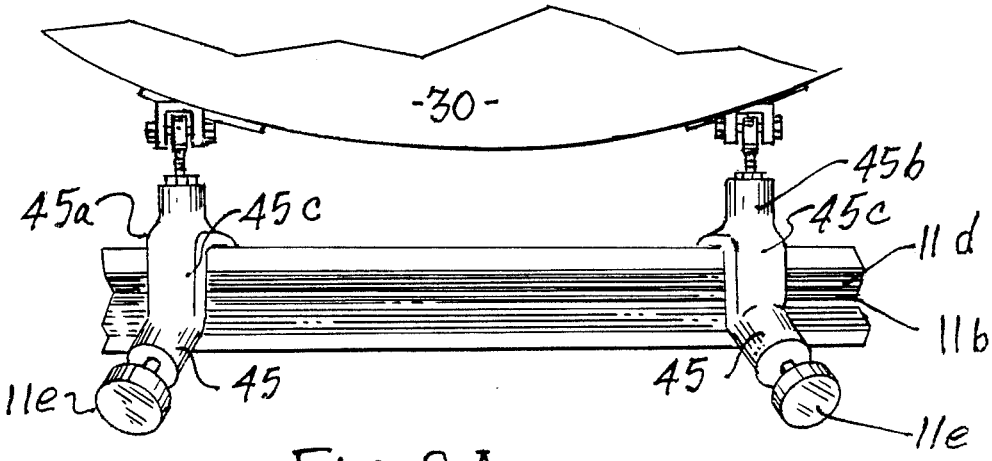
FIG. 2A is a view taken along the plane indicated by 2A—2A in FIG. 2.

Reflector or dish member 30 which is typically fabricated of spun aluminum has a feed horn 35 removably attached to the front side thereof and a transducer 36, preselector 37 and electronic circuitry 38 fixedly attached to the rear side thereof. Pivotally supported on clamp 40 which is similar to clamps 27 is elongated shaft 42. The front edge of dish 30 is pivotally supported for motion about a horizontal axis on a pair of clamp members 45*a* and 45*b*. Clamp members 45*a* and 45*b* each includes a bracket portion 45*c* which rides on the top surface of curved beam member 11*b*. Beam member 11*b* has a grooved portion 11*d* (See FIGS. 1A & 2A) against which hand clamps 11*e*, which threadably engage the clamp members 45*a* and 45*b*, can be tightened to set the dish in a preselected azimuth position. Azimuth scales 11*f* are provided along the top surface of beam 11*b* for adjusting the dish to the left or right of center line "a", as may be desired. Bracket 47 is fixedly attached to the top edge of dish 30. Bracket 47 is pivotally attached to clamp 48 which is similar to clamps 27 and is used to attach the dish to shaft 42. As schematically illustrated in FIG. 3, clamp 48 can be slidably positioned along shaft 42 as indicated by arrow 55 to bring the dish to a desired elevation position as indicated by scale markers 42*a* provided along the shaft. When dish 30 has been positioned at the desired elevation, the lever of clamp 48 is actuated to clamp the dish to shaft 42 in this desired elevation position. The dish can also be adjusted in azimuth as indicated by arrow 57 in FIG. 3, clamp 40 being actuated to lock the dish in the selected azimuth position in conjunction with the clamping action of clamp members 45*a* and 45*b*. Turnbuckles 50 are provided to anchor beams 11*a* and 11*c* rigidly in position, each of the turnbuckles having a ground anchor 53 extending therefrom into the ground.

It is to be noted that there is ample room to the rear of dish 30 to accommodate the electronics circuitry 38 and other portions of the system (36 and 37) mounted there for all elevation positions of the dish. It is further to be noted that the system includes no gearing but operates with simple manually positionable elements and manually operated clamps for positioning the antenna dish as may be desired. Further, the support structure can be rapidly and easily disassembled into separate beams 11*a*–11*c*, a separate shaft 42 and separate legs 16–18, this along with the dish structure, making for a compact group of elements for storage and transportation.

While the invention has been described and illustrated in detail, it is to be clearly understood that this is intended by way of illustration and example only and is not to be taken by way of limitation, the spirit and scope of the invention being limited only by the terms of the following claims.

I claim:

1. A portable reflector antenna assembly for installation on the ground comprising:

a plurality of vertically oriented legs positioned relative to each other on the ground to form a predetermined geometrical configuration, a plurality of beam members removably mounted on said legs and extending therebetween to form a frame having said geometrical configuration, said beam members being slidably adjustable along said legs to bring the frame to a desired position relative to the ground, one of said beam members being curved, one of said legs being positioned opposite said curved beam member, means for clamping said beam members to said legs with the frame in said desired position comprising hand operated lever cam actuators and draw bolts which are actuated by said actuators, a shaft removably mounted on said one of said legs for pivotal positioning thereon about the longitudinal axis of said one of said legs and about an axis normal to said longitudinal axis, said shaft extending upwardly from said frame, an antenna reflector removably supported between said shaft and said curved beam member, said reflector having an edge portion, a top of said edge portion of said reflector being mounted on said shaft for pivotal motion relative thereto about an axis substantially normal to the longitudinal axis of said shaft and for slidable positioning therealong to bring said reflector to a desired elevation position, at least one bottom edge portion of said reflector being mounted on said curved beam member for pivotal motion about an axis substantially parallel to the longitudinal axis of said curved beam member and for slidable positioning therealong to bring said reflector to a desired azimuth position, means for clamping said reflector to said shaft in said desired elevation position comprising a hand operated lever-cam actuator and a draw bolt which is actuated by said actuator, and means for clamping said reflector to said curved beam in said desired azimuth position comprising clamp members, said curved beam member having a grooved portion, a hand clamp threadably engaging each of said clamp members and extending therethrough, in clamping engagement with the grooved portion of the curved beam member.

2. The antenna assembly of claim 1 wherein said predetermined geometrical configuration is triangular and said legs and said beam members are both three in number.

3. The antenna assembly of claim 1 wherein said legs are driven into the ground and further including cup shaped pads through which the ends of each of said legs are fitted, the pads abutting against the ground to stabilize the legs.

4. The antenna assembly of claim 1 wherein a pair of bottom edge portions of said reflector are mounted on said curved beam member.

5. The antenna assembly of claim 1 and further including levels and a compass mounted on said frame for use in leveling and orienting said reflector.

* * * * *